US005951818A

United States Patent [19]

Gaetano

[11] Patent Number: 5,951,818

[45] Date of Patent: Sep. 14, 1999

[54] TOOLS FOR THE RESTORATION BY GLUED LAMINA OF BUCKLEPLATES DEFORMED BY COLLISION

[75] Inventor: Balbi Gaetano, R. Scrivia, Italy

[73] Assignee: B. System di Balbi Gaetano, Ronce Scrivia, Italy

[21] Appl. No.: 08/872,691

[22] Filed: Jun. 11, 1997

[30] Foreign Application Priority Data

Jun. 14, 1996 [IT] Italy ..... GE96A0056

[51] Int. Cl.[6] ..... B32B 31/00; B32B 35/00

[52] U.S. Cl. ..... 156/535; 156/94; 156/579; 72/457; 72/705; 173/91

[58] Field of Search ..... 156/247, 94, 535, 156/579; 72/457, 705; 206/373, 582; 427/142; 173/91

[56] References Cited

U.S. PATENT DOCUMENTS

| | | | |
|---|---|---|---|
| 2,871,054 | 1/1959 | Zinke . | |
| 2,987,098 | 6/1961 | Daniel | 156/94 X |
| 3,570,289 | 3/1971 | Smyers | 72/479 |
| 3,719,792 | 3/1973 | Cuccaro | 219/230 |
| 4,653,167 | 3/1987 | Mullins . | |
| 4,822,656 | 4/1989 | Hutter, III | 156/247 X |
| 4,842,912 | 6/1989 | Hutter, III | 156/247 X |
| 5,119,667 | 6/1992 | Hollis et al. | 72/453.16 |
| 5,201,211 | 4/1993 | Golembreski | 72/463 |
| 5,203,196 | 4/1993 | Jenkins | 72/391.2 |
| 5,727,418 | 3/1998 | Strozier | 72/457 |

FOREIGN PATENT DOCUMENTS

| | | | |
|---|---|---|---|
| 2 374 102 | 7/1978 | France . | |
| 86 18 109 | 11/1986 | Germany . | |
| WO 86/03454 | 6/1986 | WIPO | 156/159 |

*Primary Examiner*—Mark A. Osele
*Attorney, Agent, or Firm*—Graham & James LLP

[57] ABSTRACT

The tools for the restoration of deformed lamina require a series of capable of being deformed plaques (1,5,12,13,14, 18,18') provided with a central post or a stem (3,7,9,19,19') which are fixed by glues or adhesives with the use of an applicator (22,23,24), on the exterior of the deformed area of the lamina. They are therefore pulled through the post (3,7,9) and stem (19,19') towards the outside through the extractor (28,34), thus restoring the deformed plate (17). When the restoration has been completed the lamina is detached and possibly recovered for further use.

13 Claims, 2 Drawing Sheets

TOOLS FOR THE RESTORATION BY GLUED LAMINA OF BUCKLEPLATES DEFORMED BY COLLISION

FIELD OF THE INVENTION

Figure 1:
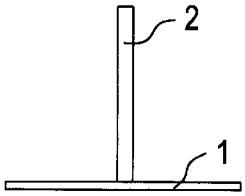

In road accidents the body of cars are subjected to various deformations, which (if not too major) may be restored to original condition. This is similar to any manufactured item in metallic plate which has been variously subjected to deformations, scratches, etc., which should be returned to its original state wherever possible.

The present invention relates to body car repair restoration, but is not limited because the present tools and their relative method of use can be adopted in the case of deformation to any other metallic surface (container, tanks and metallic structures in general).

BACKGROUND OF THE INVENTION

Nowadays for the restoration of car bodies if the estimate of the extent of damages is not too great, the damaged parts are usually substituted with new ones. However, if the damages are of a small extent (buckleplates, scratches, etc.) it is possible to return the plates sheet to its original state, by pounding the sheet, with the special tools, from the inside towards the exterior of the deformed plates.

Unfortunately the restoration of the limited damages has become more complicated due to the various components of the car which run through the inside of the body of the car. For example it is difficult to restore a car door from the inside due to such items as electric windows, central locking, alarm systems, etc. Great difficulties are always found with the restoration of box-type parts of the car's body such as the edges of the car door. Nowadays, after paint is removed from the part, various posts or pulling elements which are pulled from the exterior are welded to the part being repaired and are cut or removed when the restoration is completed. This way of proceeding is always complicated and sometimes does not give satisfactory results because the gripping of these posts or gripping elements occurs on very small surfaces with the risk of breaking the plates. This way of proceeding also presents high cost and great inconvenience.

SUMMARY OF THE INVENTION

The present invention comprises a kit of tools with lamina and a relative system of use which allows the restoration of the plates while permitting working from the exterior of the sheet being repaired. Where these lamina tools are externally fixed to the plate sheets to restore them with adhesives or gluing substances, these laminae can be pulled towards the exterior and are easily detached and possibly recovered: all without having to prior remove the paint. It will be only necessary to take the shine off and so make the surfaces rough, without or with limited production of dust. These tools are substantially composed of a first series of lamina or thin plaques of malleable material mounted singularly or in multiples on singular pothooks or central posts.

By gluing (using a manual applicator) the external surface of each lamina or thin plaque onto the deformed area, it is possible (by using an extractor tool which hooks the pothook from the exterior with a mandral) to return the plate sheet as much as possible to its original state. After the rectification of the plate (of the car), the lamina (of the tool) or thin plaque is detached from the body car sheet. This lamina or thin plaque can assume any dimension or comformation, such as a circular disc, elliptic, etc., so that it is possible to use the more suitably shaped thin plate for a specific damage.

According to the invention, the tool kit also comprises a second series of T-plaques in a single element either together in one element or assembled, to rectify the linear deformations or scratches. These T-plaques are made by coldpressing or drawing from a sheet of strip in malleable material with the creation of two lateral wings and one central prominent flap which forms a hole or eyelet. The aforementioned lateral wings and aforementioned central flap can be formed by numerous elements adjacent to each other and mounted on an adjustable connecting element and inserted in the eyelet of the flap. By gluing (through a manual applicator) one or more plaques or series of plaques along the linear deformation, it is possible by using the extractor which hooks its proper head to the external part of the eyelet to steadily, restore the deformation. Obviously the first and the second series of laminae, the applicators, the extractor with its hooking heads, as well as the various assessories like glue or adhesives, medium heating or cooling means, will be part of a complete kit in which the series of laminae can be either disposed of or reused.

In this way, according to the aims of the invention, it is possible to restore the near totality of the plate parts of the body of the car in one damaged vehicle, including the boxed parts, with simplicity whilst working from the outside. Obviously it is possible to foresee further series of laminae or plaques with other conformations and other hooking systems at the extractor, to be used for particular cases of deformation of the body car sheet.

The invention in words is clarified in practice and exemplified in the drawings that follow, where:

SHORT DESCRIPTION OF THE INVENTION

Figure 4:
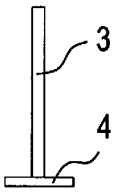
Figure 5:
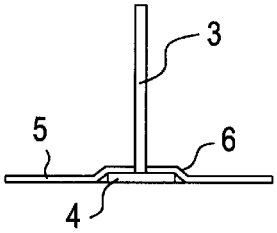
Figure 7:
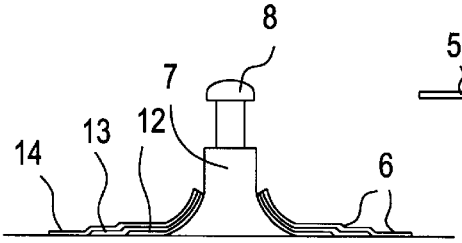
Figure 2:
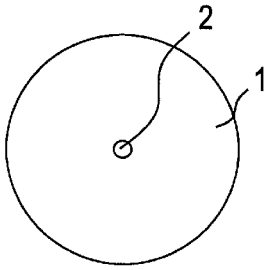
Figure 6:
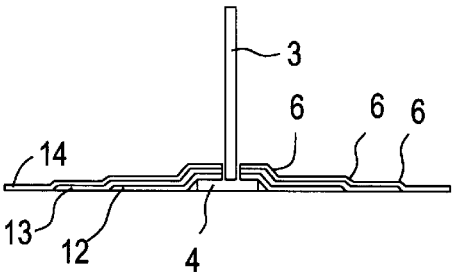
Figure 8:
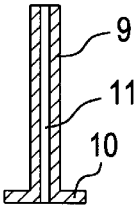
Figure 3:
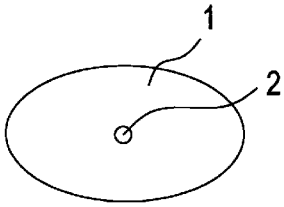
Figure 9:
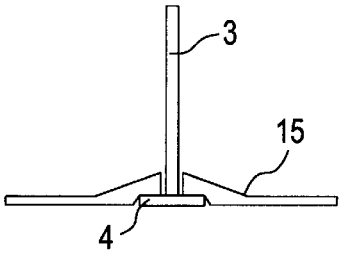
Figure 10:
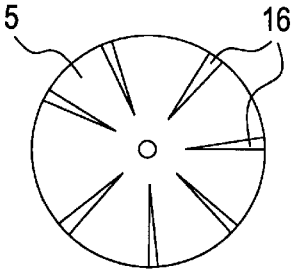
Figure 11:
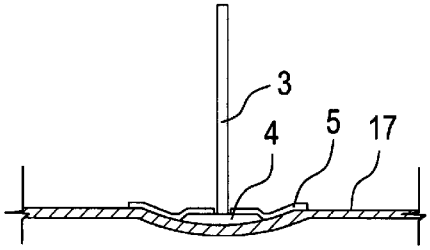
Figure 12:
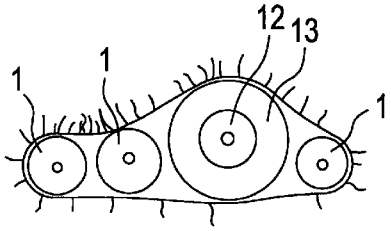
Figure 13:
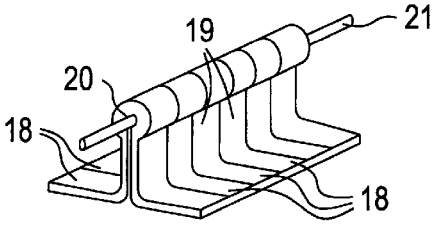
Figure 14:
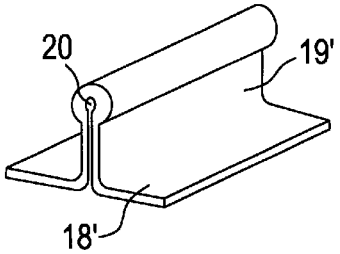
Figure 15:
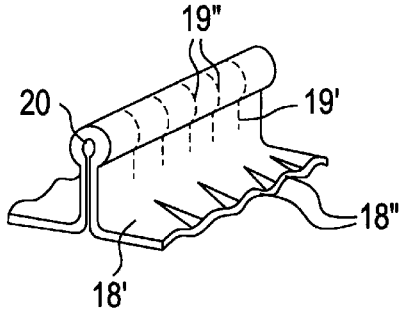
Figure 16:
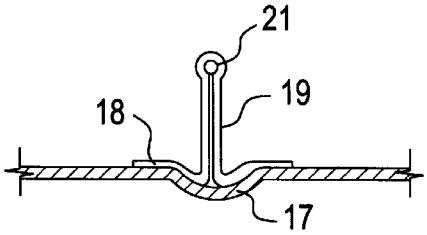
Figure 17:
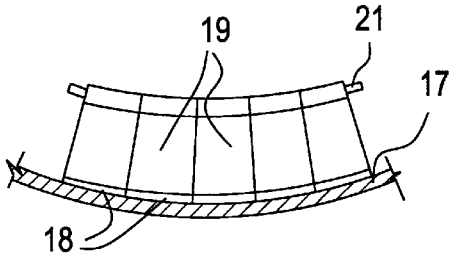
Figure 18:
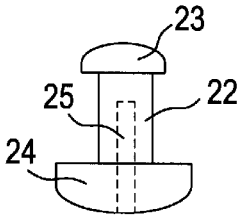
Figure 19:
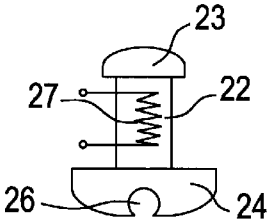
Figure 20:
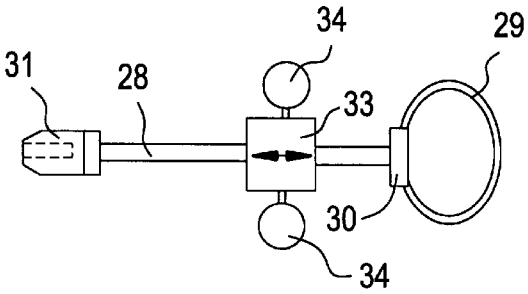
Figure 21:
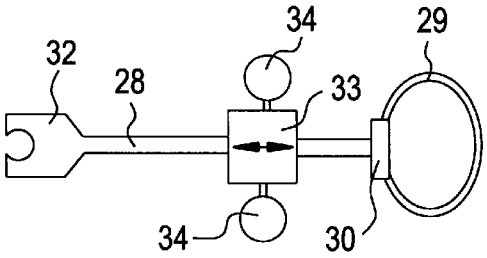

FIG. 1 shows the lateral perspective of the tool with one piece of plate with its pothook or post, FIG. 2 shows the perspective from above of the one plate tool of FIG. 1 with circular conformation, FIG. 3 shows the perspecitve from above of the one plate tool of FIG. 2 with elliptic conformation, FIG. 4 shows the lateral perspective of a pothook with base for attaching the laminae to mount, FIG. 5 shows a lateral perspective of a single lamina mounted on the pothook of FIG. 4, FIG. 6 shows a lateral perspective of a series of laminae mounted on the pothook of FIG. 4, FIG. 7 shows in lateral perspective, another specimen of a pothook with the base shaped for multiple laminae and superior hooking head at the extractor, FIG. 8 shows in central cross section another specimen of pothook with base provided with an axial hole for the passing through of the adhesives, FIG. 9 shows in lateral perspective, a lamina with a variable section larger at the centre and tapering towards the edge and with variable resistance, FIG. 10 shows in perspective, from above a specimen of lamina with radial cuts or radial undulations for an ideal adaptation on the surfaces to be restored, FIG. 11 shows in lateral perspective, a specimen of application of a lamina or plaques on a deformed body car sheet, FIG. 12 shows in perspective, from above, the use of a multiple number of laminae or plaques for the restoration of a large deformation, FIG. 13 shows the three dimensional perspective of a T-linear tool with multiple laminae for the restoration of scratches or linear deformations, FIG. 14 shows the three dimensional perspective of the T-linear tool of FIG. 13 with the singular lamina, FIG. 15 shows the three dimensional perspective of the T-linear tool of FIG. 14 with undulation on the lamina for the best adaptation to the surfaces to be restored, FIG. 16 shows a transversal section of a ridge with relative T-linear tool attached to it, FIG. 17 shows a longitudinal section of a ridge with relative T-linear tool attached to it, FIG. 18 shows an example of an applicator for the tool with a central post plate, FIG. 19 shows a specimen of an applicator for a T-linear tool, FIG. 20 shows an example of a pull machine for the abovementioned tool with pothook or posts, FIG. 21 shows a machine useful for pulling the tool with a different head.

DETAILED DESCRIPTION OF THE INVENTION, THE DRAWINGS AND THE PREFERRED EMBODIMENTS

With reference to the aforementioned drawings, the FIGS. 1 to 12 referring to a first series of laminae or post plaques in its various embodiments. In FIGS. 1, 2 ,3 the lamina 1 can assume any shape like circular, elliptical, etc. and presents a vertical central post 2 or pothook. Lamina 1 and pothook 2 are made of a single piece or joined together by welding.

FIGS. 4 to 9 show lamina mounted on a self-standing post. Such post 3, as in FIGS. 4 and 5 presents a small base 4 fixed at the post itself and in this post is inserted a lamina 5, provided with a circular shaped member 6 so that the lower surface of the lamina is located at the same level of the lower surface of base 4.

In FIG. 6 it is envisaged that the use of a number of laminae (12, 13, 14) mounted on the same post 3 will allow the adaptation of the tools with lamina to the dimension of the deformation to restore and also to provide with wider surfaces greater gripping forces. The laminae 12, 13, 14 have circular bend useful for make a lower surface common for all the laminae and for base 4.

In FIG. 7 the base 7 is shaped to receive numerous laminae 12, 13, 14 and the post presents at the upper extremity a swelling 8 for grasping the part that pounds as will be further explained. Such a tool, according to FIG. 7, is useful when the restoration of greater extent is required.

In FIG. 8 a post 9 is shown and relative base 10 which are passed through by a hole 11 for the injection of the glue. Since the aforementioned laminae are glued onto the body car sheet for repairing and they are pulled by an extractor tool described below, in order to restore damaged sheets we need to evaluate the possibility of breaking the lamina in the area of the base. Therefore the tool with single lamina will be used for pulling actions of limited extent, while the tool with multiple lamina will be used for pulling actions of greater extent. It is also possible to use lamina 15 with variable thickness as in FIG. 9, in which the lamina presents decreasing resistance from the internal section towards the periphery.

The said laminae 4, 1, 5, 12, 13, 14, 15 can present engravings or radial undulations 16, as in FIG. 10, in order to adapt and glue the lamina with better precision at surface 17 of the body car shape being restored. The undulations can be larger towards the centre in order to make the resistence of the lamina decrease from the centre towards the edge.

In FIG. 11 the application through glue or adhesives of lamina 5 to body car sheet 17 is exemplified, so subsequently by pulling post 3 by using the extractor tool, the initial shape of the sheet is restored. In FIG. 12 the use of more posted laminae of different sizes is exemplified for the restoration for wide deformation.

In FIGS. 13 to 17 a second series of T-laminae is represented, used for the restoration of linear deformation of car sheets as scratches. In FIG. 13 such a tool is composed of a certain number of laminae shaped for T pulling, where each lamina presents lower opposite wings 18 and a central stem 19 created by the overlapping of the central areas of the lamina, with formation at the free extremities of a hole or eyelet 20 in which a deformable element is inserted, 21 like a thread or bar, to join subsequent laminae.

The wings 18 can be substituted by a single lamina 18' and relative stem 19', obtained by printing or wire drawing. The aforementioned lamina obtained by wire drawing cannot present the stem with a double overlapping surface and cannot have the superior hole or eyelet; on the other hand the wire drawn lamina can present variable thickness according to the need in its various parts. The aforementioned large lamina 18' can present undulations 18" in order to improve the adherence and glue the lamina to the sheet being treated as in FIG. 15. The aforementioned undulation 18" can be bigger towards the centre in order to give more resistence to the lamina decreasing towards the edge.

Subsequent lamina 18' or groups of lamina 18 are joined on the joining element 21 to cover the length of the linear deformation of the sheet 17. With the wire drawn lamina it is cut from the wire drawn product to the length necessary for the restoration.

If sheet 17 is curved as in FIG. 17 the laminae 18 is adjusted to this curvature by bending accordingly the joining element 21. For the wire drawn lamina it is possible to obtain such deformation by engraving the head and part of the stem in consecutive sections 19'.

As mentioned above all these posted laminae 1, 5, 12, 13, 14, 15, or a T posted lamina 18, 18' are applied and glued to the sheet so as to restore with post 2, 3, or stem 19, 19' facing the exterior of the body car sheet 17. This can be mounted manually, but it is best to use an applicator tool as in FIGS. 18, 19. The aforementioned applicator specimen as in FIG. 18 shows a central cylindric body 22 of rigid material which presents on the top part an elastically deformable plug 23 of manual pressure and an lower elastically deformable plug 24 which is forced on the lamina. Such applicator tools 22, 23, 24 present a central hole 25 designed to receive post 2,3 of the lamina where such holes can also be useful for the passage of the glue or of the adhesive by using a post as in FIG. 8. In FIG. 19 the applicator specimen 22, 23, 24 is represented for the T lamina provided with a groove 26 for hooking the T shaped stem to the lamina or the head of the lamina to the post of FIG. 7.

In the exemplified embodiment of FIG. 19 it is also indicated the possible electric resistance 27 for heating the applicator, the lamina and the body car sheet in case of the use of thermalglue. Such applicators can also present heating and cooling tools in order to be used for both the application of the lamina on the sheet using thermalglue and the detachment of the lamina. For these ends the applicator can present suitable tubes for hot and cold air current in order to heat up and cool down the area of gluing to the lamina.

Alternatively the lower plug 24 can be substituted by tools with compressors or compressor controlled posts that lay on the lamina and press it elastically against the body car sheet.

However, the aforementioned applicator is made in material that does not stick to the glue or the adhesive.

FIGS. 20 and 21 show a specimen of the extractor formed by a bar 28 provided with a handle at the extremity 29 for manual grip with crash plate 30 and at the other extremity a mandrel head 31 or head with a shaped groove 32 to hook the laminae for both posted laminae and T-shaped laminae. On the bar 28 a mass 33 of variable weight is designed through adding or subtracting other masses 34.

By manually action with the masses 33, 34 subsequent hammering actions are obtained and so the consequent gripping restores the damaged sheets. If more laminae are present for each damaged side, pulling in the lamina in succession is required in order to deform the body car sheet uniformly.

Obviously the extractor tool can be substituted by any other tool like a routinely used rubber tool which allows a traction of the sheet as described above. The laminae having a different nature from those described can be in thin metallic or plastic material capable of bearing traction forces and are malleable so as to adapt to the form walls and be fixed with glues or adhesives.

For greater forces it is preferrable to use multiple plaques or plaques of variable thickness as described above.

In order to fix the aforementioned lamina to the body car sheet it is possible to use any type of glue or adhesive but it is best to use a thermal glue which by heating the walls to attach or detach, allows a better adhesion or detachment for the potential recovery of the lamina used.

After the application of the plaque with the thermal glue pulling down the glued area by blowing cool air, or water refrigerating products is required. All of the tools described including all the accessories of use are part of a kit which can be integrated with new plaques to substitute for the ones used in both disposable and non-disposable. embodiments.

Naturally other series of laminae or plaques of shapes different from the ones described can be foreseen for particular cases of body car restoration always remaining within this invention, where these laminae or plaques are fixed with glues to the exterior of body car sheets, they are pulled towards the outside for the restoration of the body car sheets themselves, where the aforementioned body car sheets to be restored can be part of bodies of cars or part of machinery or various appliances.

What is claimed is:

1. Tools in a kit for the restoration of automobile body sheets deformed by collision, said tools comprising:

a first series of flat, thin laminae (1, 5, 12, 13, 14) comprised of malleable material, and assembled in either singular or multiple number on a post or central pothook (3, 7, 9) for the restoration of wide surface deformations of a body sheet, a second series of T-shaped laminae (18, 18') for linear deformation of the body sheet, constructed in one piece or multiple elements, of malleable material, and comprising two opposite lower wings (18, 18') and a central stem (19, 19') formed by the overlapping of the central areas of the laminae, where the central stem comprises at a free extremity thereof a hole or eyelet (20) adapted to receive a deformable element (21) of union of the various subsequent laminae (18, 18'), manual applicators (22) with a central rigid body, with an upper plug (23) of material elastically deformable with respect to manual pressure and a lower plug (24) of elastically deformable material for the application of laminae (1, 5, 12, 13, 14, 18, 18') and their fixing with glue or adhesive substances at the body sheet (17) to be restored, where at least one applicator comprises a central hole (25) or a particular shape (26) for gripping the post (3, 8, 9) or the stem (19, 19') of the body sheet, at least one extractor tool formed by a bar (28) comprising at one end a crashplate (30) and handle for manual gripping (29), and at another end a headed mandrel (31) or a groove (32) to hook the glue lamina of both posted and T-shaped type and presenting a mass (33) of weight made variable through adding or subtracting (34) and suitable for pounding the sheet, for the subsequent extraction towards the outside of the lamina and body sheet (17) deformed to be restored, glue or adhesive substances for fixing the laminae to the body sheet to be treated, optional heating or refrigerating means to be used with said glue when said glue is thermally activatable, so that having chosen the lamina or laminae specifically useful for the restoration of the body sheet, these are glued at the outside of the deformed area and are subsequently pulled from the outside through the extractor tool, pulling at the same time, the body sheet towards the aimed conformation and wherein the laminae are detached.

2. Tools according to claim 1 wherein the flat lamina 1 is fixed by compression or soldering to post 2.

3. Tools according to claim 1 wherein the post (3) comprises a lower base (4, 7) on which one or more laminae (5, 12, 13, 14) is inserted on the post (3).

4. Tools according to claim 1 wherein multiple laminae (12, 13, 14) comprise circular bended members of ring shapes; wherein said members are shaped whereby all the laminae have respective lower surfaces at the same level of a base surface level (4, 7).

5. Tools according to claim 1 wherein the post (9) and the base (10) comprise a through-hole (11) for the introduction of the glue therethrough.

6. Tools according to claim 1 wherein the lamina (15) comprise variable thicknesses tapering towards an outer periphery with the maximum thicknesses in the center thereof.

7. Tools according to claim 1 wherein the laminae (5, 12, 13, 14, 15) comprise generally circular or elliptic configurations and are etched or rippled (16) as means to provide better adherence to the body sheet (17) to be restored and for a better resistance to a pulling force exerted thereon.

8. Tools according to claim 1 wherein the T-shaped laminae (18, 18') are rippled (18') as means to provide a better adherence to the body sheet (17) to be restored and for a better resistance to a pulling force exerted thereon.

9. Tools according to claim 1, wherein the central hole (25) of the applicator (22, 23, 24) is adapted to be used for introducing the glue on the lower surface of the laminae.

10. Tools according to claim 1, wherein the T-shaped lamina (18') is formed by wire drawing with variable thickness and with a stem (19') having a smooth surface and wherein the upper head and part of the stem comprise etchings adapted to permit the deformation of the lamina according to the shape of the body sheet.

11. Tools according to claim 1, wherein the applicator (22, 23, 24) comprises hoses for the inlet of hot or cold air for effecting adhesion or softening of thermally activatable glue for fixing the lamina to the body sheet with said glue.

12. Tools according to claim 1, wherein the applicator (22, 23, 24) comprises the lower pressure plug of the lamina formed by resilient elements or by spring-loaded posts.

13. Tools according to claim 1, wherein the applicator (22, 23, 24) comprises an internal resistance heating means (27) adapted for heating the lamina and the body sheet and thermally activatable glue.

* * * * *